US011674394B2

(12) United States Patent
Di Paola et al.

(10) Patent No.: US 11,674,394 B2
(45) Date of Patent: Jun. 13, 2023

(54) GAS TURBINE ENGINE ROTOR ASSEMBLY AND METHOD OF USING SAME

(71) Applicant: PRATT & WHITNEY CANADA CORP., Longueuil (CA)

(72) Inventors: Franco Di Paola, Montreal (CA); Julien Lalonde, Varennes (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/173,493

(22) Filed: Feb. 11, 2021

(65) Prior Publication Data

US 2022/0251957 A1 Aug. 11, 2022

(51) Int. Cl.

| | |
|---|---|
| ***F01D 5/02*** | (2006.01) |
| ***F01D 5/06*** | (2006.01) |
| *F01D 5/08* | (2006.01) |

(52) U.S. Cl.

CPC ..... *F01D 5/022* (2013.01); *F01D 5/025* (2013.01); *F01D 5/066* (2013.01); *F01D 5/087* (2013.01); *F05D 2240/24* (2013.01); *F05D 2250/73* (2013.01); *F05D 2260/4031* (2013.01)

(58) Field of Classification Search

CPC ..... F01D 5/022; F01D 5/025; F01D 5/066; F01D 5/06; F01D 5/085; F01D 5/087; F01D 5/026; F05D 2260/4031; F05D 2260/53

See application file for complete search history.

(56) References Cited

U.S. PATENT DOCUMENTS

| | | | | | |
|---|---|---|---|---|---|
| 3,356,339 | A * | 12/1967 | Thomas | F01D 5/066 | 416/198 A |
| 4,123,199 | A * | 10/1978 | Shimizu | F01D 5/066 | 416/198 A |
| 4,468,148 | A * | 8/1984 | Seymour | F16D 1/06 | 416/198 A |
| 5,628,621 | A * | 5/1997 | Toborg | F01D 5/066 | 416/198 A |
| 6,572,337 | B1 * | 6/2003 | Herron | F01D 5/066 | 416/198 A |
| 10,598,096 | B2 * | 3/2020 | Hugon | F01D 5/084 | |
| 2012/0177494 | A1 * | 7/2012 | Parashar | F01D 5/026 | 416/170 R |
| 2013/0236315 | A1 * | 9/2013 | Kumar | F01D 5/066 | 416/198 A |
| 2013/0336785 | A1 * | 12/2013 | Hummel | F01D 5/066 | 416/198 A |
| 2014/0099210 | A1 * | 4/2014 | Miller | F01D 5/066 | 416/198 A |
| 2019/0218922 | A1 * | 7/2019 | Breen | F01D 5/026 | |

* cited by examiner

*Primary Examiner* — Eldon T Brockman

(74) *Attorney, Agent, or Firm* — Norton Rose Fulbright Canada LLP

(57) ABSTRACT

The rotor assembly can have a first disc having a first body extending circumferentially and radially around the axis, a first set of circumferentially distributed blades protruding radially from the first disc, and a male spline extending axially relative the first body, the male spline extending around and along the axis, and a second disc having a second body extending circumferentially and radially around the axis, a second set of circumferentially distributed blades protruding radially from the second disc, and a female spline extending around and along the axis, the female spline receiving the male spline in a spline engagement.

16 Claims, 3 Drawing Sheets

GAS TURBINE ENGINE ROTOR ASSEMBLY AND METHOD OF USING SAME

TECHNICAL FIELD

The application relates generally to gas turbine engines and, more particularly, to rotor assemblies thereof.

BACKGROUND OF THE ART

Gas turbine engines have one or more rotors which are configured to rotate within an engine casing. The rotors can have a plurality of components axially mounted to one another for rotation around a common axis, such as two compressor discs or two turbine discs, and/or a disc and a shaft, for instance. Different techniques exist to assemble such components to one another and all have advantages and disadvantages which can make a specific technique better adapted or not for a specific embodiment. Indeed, gas turbine engine design is a complex environment which strives to achieve an optimal balance between a number of factors such as cost, durability, maintenance and reliability. In aircraft applications, in particular, weight can be a significant design consideration. Accordingly, even though existing techniques were satisfactory to a certain degree, there always remains room for improvement.

SUMMARY

In one aspect, there is provided a gas turbine engine rotor assembly configured to rotate around an axis, the rotor assembly comprising a first disc having a first body extending circumferentially and radially around the axis, a first set of circumferentially distributed blades protruding radially from the first disc, and a male spline extending axially relative the first body, the male spline extending around and along the axis, and a second disc having a second body extending circumferentially and radially around the axis, a second set of circumferentially distributed blades protruding radially from the second disc, and a female spline extending around and along the axis, the female spline receiving the male spline in a spline engagement.

In another aspect, there is provided a method of transmitting torque from a first disc to a second disc in a gas turbine engine, the first disc and the second disc each having a corresponding set of blades, the sets of blades exchanging torque energy with a working fluid, the method comprising transmitting torque from the first disc to the second disc via a spline engagement.

In a further aspect, there is provided a gas turbine engine having in serial flow communication along a main gas path a compressor section, a combustor and a turbine section, at least one of said compressor section and said turbine section having a rotor assembly configured for rotation around an axis relative a stator, the rotor assembly comprising a first disc having a first body extending circumferentially and radially around the axis, a first set of circumferentially distributed blades protruding radially from the first disc across the main gas path, and a male spline protruding axially from the disc, the male spline extending around and along the axis, a second disc having a second body extending circumferentially and radially around the axis, a second set of circumferentially distributed blades protruding radially from the second disc across the main gas path, and a female spline extending around and along the axis, the female spline receiving the male spline in a spline engagement, and the stator having a set of circumferentially distributed vanes extending radially across the main gas path, axially between the first and second sets of blades.

DESCRIPTION OF THE DRAWINGS

Reference is now made to the accompanying figures in which.

DETAILED DESCRIPTION

Figure 1:
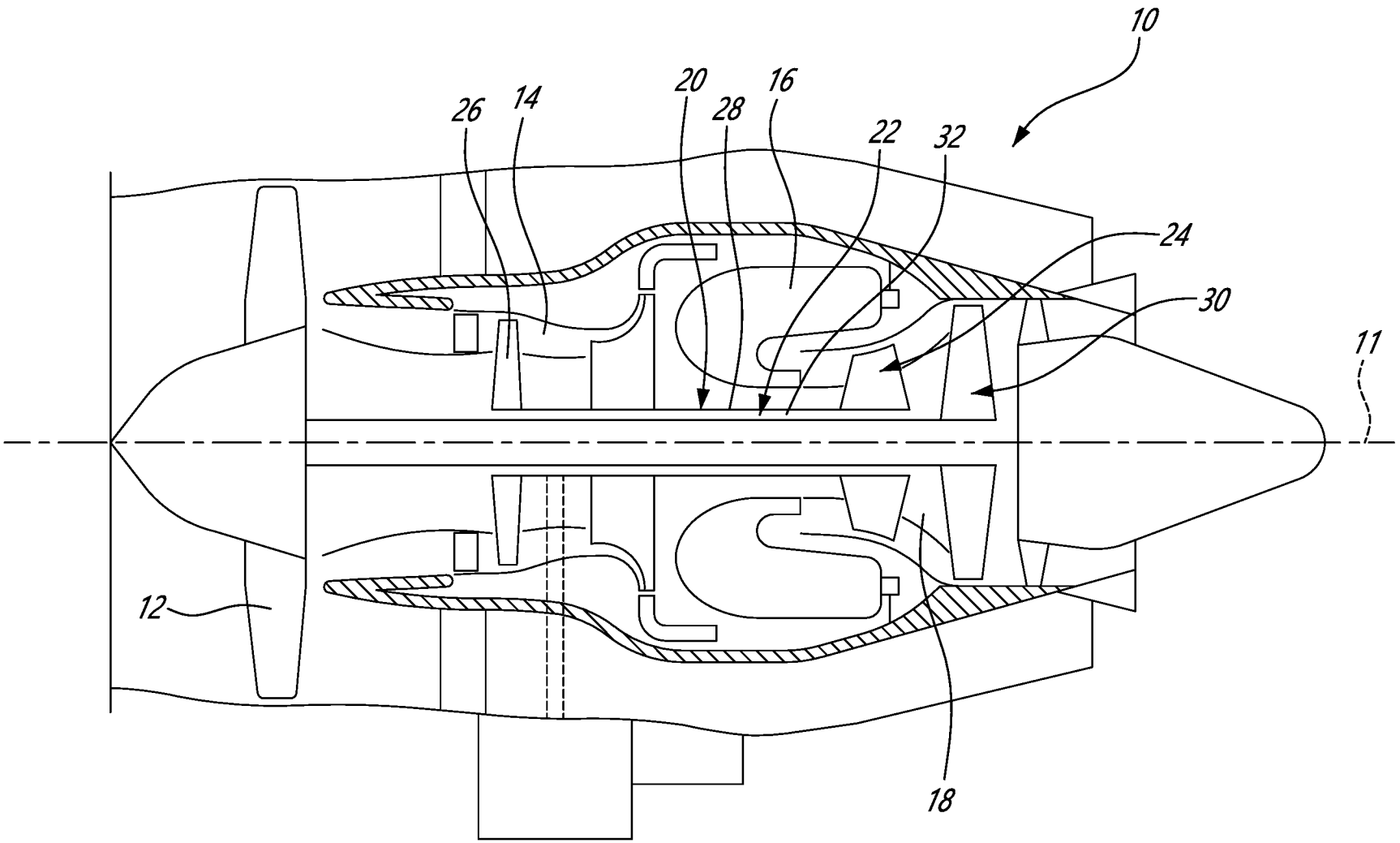
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases around the engine axis 11, and a turbine section 18 for extracting energy from the combustion gases. More specifically, in this embodiment, the flow divides downstream of the fan 12 into a main gas path extending through the compressor section 14, combustor 16 and turbine section 18, and a bypass path extending around the engine core.

Gas turbine engines can have a plurality of rotors. In the illustrated embodiment, for instance, the gas turbine engine 10 has a high pressure rotor assembly 20 and a low pressure rotor assembly 22. The high pressure rotor assembly 20 can include a high pressure turbine disc assembly 24, and/or a compressor disc assembly 26, interconnected to one another by a high pressure shaft 28. The low pressure rotor assembly 22 can include a low pressure turbine disc assembly 30 and the fan 12, interconnected to one another by a power shaft 32. Different builds of gas turbine engines can have significantly different configurations. For example, in turboprop and turboshaft applications, the power shaft can connect to a propeller or to helicopter blades, respectively, and the fan and bypass path can be absent. In some gas turbine engines, more than two rotors may be used.

Figure 2:
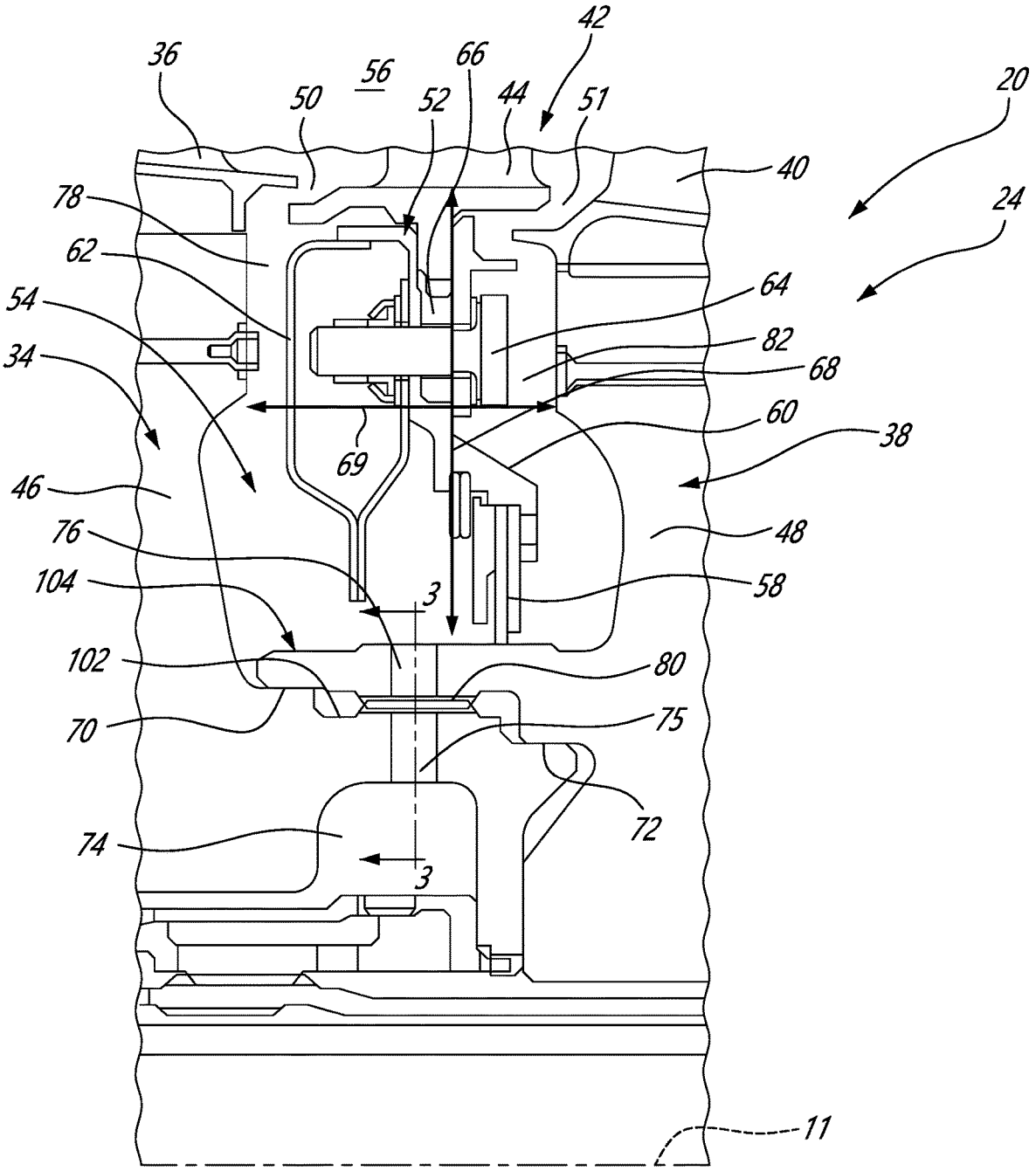
FIG. 2 is an enlarged portion of FIG. 1, showing a gas turbine engine rotor assembly in accordance with one embodiment.

An example rotor assembly 20, and more specifically a portion thereof having a turbine disc assembly 24, is presented in FIG. 2. The rotor assembly 26 has a first disc 34 having a corresponding first set of blades 36 and a second disc 38 having a corresponding second set of blades 40. Both sets of blades 36, 40 include a plurality of radially-extending, circumferentially distributed blades configured to interact with the working fluid by extracting energy from the working fluid in the form of torque. In the alternate embodiment of a compressor disc assembly, the blades can be configured to interact with the working fluid by imparting energy into the working fluid in the form of pressure and temperature. In both cases, the blades can be said to exchange torque energy with the working fluid. It is common in gas turbine engines to have a stator 42 having a set of vanes 44 positioned between axially adjacent sets of blades 36, 40 to favor efficient energy transfer. The blades have complex shapes and are often manufactured separately from a body 46, 48 of the discs 34, 38 and later assembled thereto.

Returning to FIG. 1, in the embodiment illustrated, both shafts 28, 32 transfer torque. The high pressure shaft 28 transfers torque extracted by the high pressure turbine rotor 24 from a high pressure portion of the turbine section 18 to the compressor rotor 26. The power shaft 32 transfers torque extracted by the low pressure turbine rotor from a low pressure portion of the turbine section 18 to the fan for pre-compression and thrust. When a compressor disc assembly 26 or a turbine disc assembly 24, 30 includes two or more discs 34, 38, it is common to manufacture the disc bodies 46, 48 initially as separate components which are to be assembled to one another and to the corresponding shaft 28, 32. This can be required, for example, in a context where the discs 34, 38 would be too difficult to manufacture as a single part due to issues such as complex shape. It will be understood that in such situations, torque energy is not only exchanged by the individual disc 34, 38 and the working fluid, but also transferred from one disc 34, 38 to the other. In this context, the two or more discs 34, 38 are to be assembled to one another in a manner which satisfies the need for torque transfer from one disc 34, 38 to the other, and ultimately with the shaft 28, 32.

Various other requirements can exist. For instance, it is relatively common in the case of a turbine section 18 to bleed air from the compressor section 14 and to inject it into one or more annular gaps 50, 51 which can exist between the blade root zone (radially inner end) of a set of blades 36, 40 and the vane root zone of a set of vanes 44. The gaps 50, 51 can fluidly connect the disc cavity 54 to the main gas path 56. This can be used to control temperature of turbine section components during operation. This can require designing the gas turbine engine 10 with corresponding compressed air paths, and can require the use of a sealing assembly 52 in a disc cavity 54 inter-disc cavity which extend axially between adjacent disc bodies 46, 48 and radially inwardly from the main gas path 56. A sealing assembly 52 can include a seal runner 58, one or more baffles 60, 62, and can require to be axially retained to the set of vanes 44 in a centering manner. To this end, the stator 42 can further include an axial retention feature 64 and a centralizing feature 66. The seal assembly 52 can partition an air passage portion 78 of the disc cavity 54 which is in fluid communication with a first gap 50, from a sub cavity 82 which is in fluid communication with a second gap 51, for instance, from the point of view of fluid flow communication and/or fluid pressure environment.

Especially in smaller engines the zones of the disc cavities 54 can be challenging to design, particularly from the point of view of fitting, within a fairly limited amount of radial space 68 and axial space 69, components such as baffles 60, 62, centralizing features 66, axial retention features 64, and seal runners 58. The radial space 68 can be considered limited and impose design constraints when it is below 3 inches in some embodiments, below 2 inches in some embodiments, and can be considered particularly limited when below 1.5 inches for instance. The design of the engagement features structurally connecting axially adjacent discs 34, 38 which were initially separately manufactured can also be challenging, especially when taking into consideration load bearing considerations (which can warrant using one or more spigot engagements 70, 72), air system passages 74, 75, 76, 78, and torque transmission. Torque transmission requirement themselves typically involve criteria such structural resistance in different operating conditions and durability. It was found that former assembly techniques could leave a want for more available space between discs in some embodiments.

It was found that using a spline engagement 80 to provide torque transmission between discs 34, 38 during operation of the engine could be advantageous and provide more available radial space 68 and/or axial spacing 69 in the disc cavity 54, facilitating the accommodation of components such as air passages 78, sealing assemblies 52 in one embodiment, the use of a spline engagement 80 can leave more available radial and axial space 68, 69 between the discs 34, 38 to accommodate one or more of a baffle 60, 62, a centralizing feature 66, an axial retention feature 64, and a sealing assembly 52, in addition to facilitating the integration of one or two spigots 70, 72 and/or cooling air passages 74, 75, 76, 78. In one embodiment, the use of a spline engagement 80 to transmit torque between two axially adjacent discs 34, 38 can facilitate a double spigot fit design (i.e. use of two spigot engagements 70, 72) between the discs 34, 38, such as allowing to integrate the spline engagement 80 axially between the two spigot engagements 70, 72 for example. Each spigot engagement 70, 72 can involve an interference or tight fit between a male perimeter formed in a first one of the discs 34, 38 and a female perimeter formed in the other one of the discs 34, 38. In the illustrated example, for instance, both spigot engagements 70, 72 involve the use of a male cylindrical surface formed in the first disc 34 interference fitted into a corresponding female cylindrical surface formed in the second disc 38. In one embodiment, the use of a spline engagement 80 can facilitate manufacturing. The use of a spline engagement 80 can meet life requirements in addition to providing one or more additional advantages over other assembly techniques.

Figure 3:
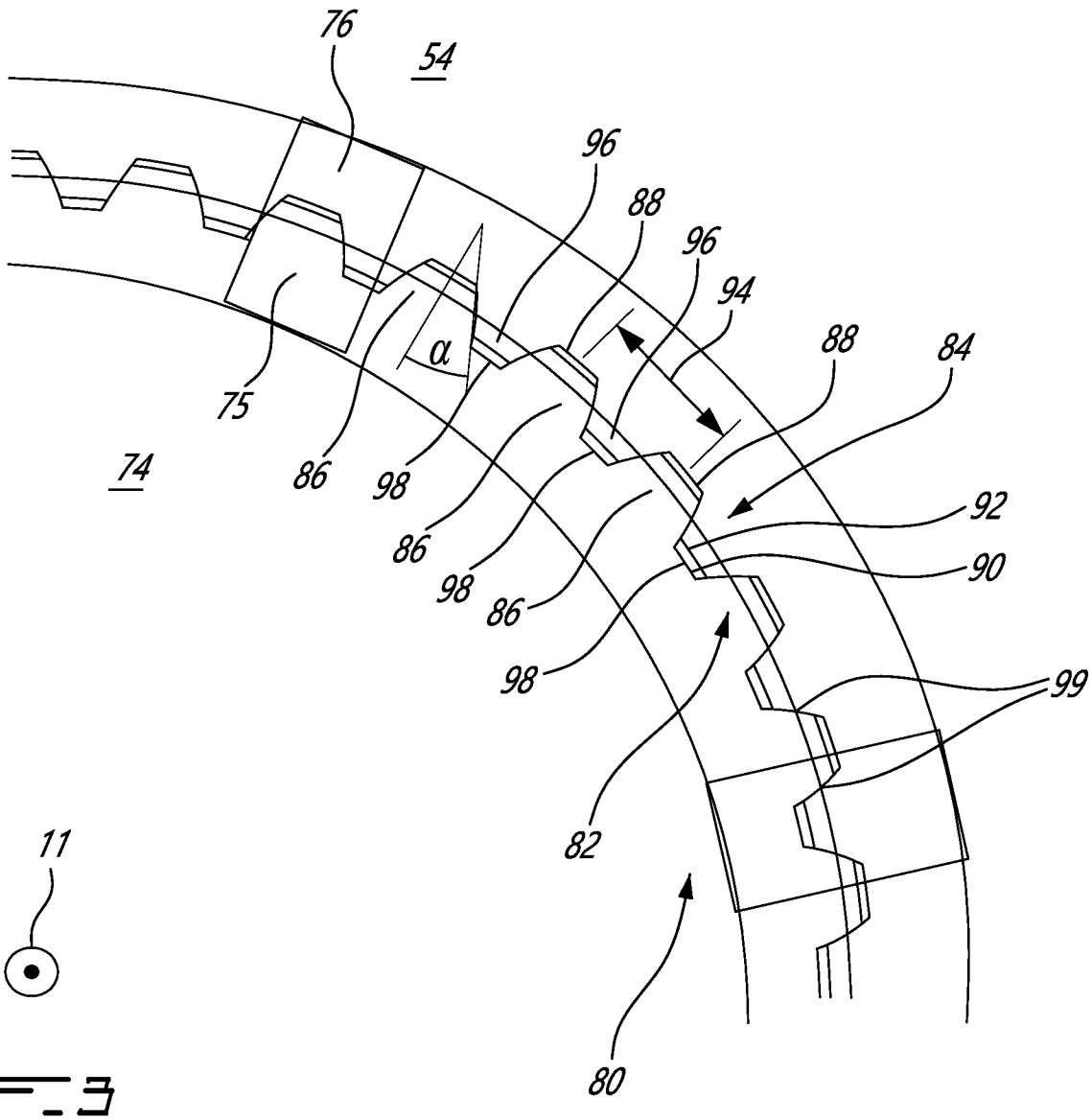
FIG. 3 is a cross-section view taken along lines 3-3 of FIG. 2.

In the embodiment presented in FIGS. 2 and 3, the spline engagement 80 has a male spline 82 (sometimes referred to as a shaft) provided as part of the first disc 34, and a female spline 84 (sometimes referred to as a hub) provided as part of the second disc 38. It will be noted here that the expressions first and second are chosen arbitrarily with respect to male/female features and used solely to facilitate the process of distinguishing reference to one disc from reference to the other, adjacent disc, they are not intended herein as having any intrinsic meaning or to impart the attribution of a male or female characteristic, the male and female features can be inversed in alternate embodiments. Both the male spline 82 and the female spline 84 can be said to extend around and along the axis 11. The female spline 84 receives the male spline 82 axially, into the spline engagement, and otherwise said, the male spline 82 is axially engaged into the female spline 84 at assembly to remain axially engaged therewith during operation of the gas turbine engine.

As known in the art, and as depicted more explicitly in FIG. 0, a spline engagement 80 can involve the mating engagement of circumferentially crenellated features which will be referred to herein as keys 86 and grooves 88. The keys 86 can be seen as axially elongated features which protrude radially from an otherwise cylindrical radially outer surface 90, and the grooves 88 can be seen as axially elongated features which are radially recessed from an otherwise cylindrical radially inner surface 92. Each one of the keys 86 is radially engaged in a corresponding one of the grooves 88. The engagement can be relatively tight circumferentially, or snug, to allow the torque-transmitting spline engagement 80 around the axis 11 during operation, while allowing the axial sliding engagement at assembly due to the common axial orientation. The keys 86 can be said to be circumferentially interspaced from one another such as the grooves 88. Axially elongated refers to an axial length which is greater than, and typically greater than twice or more, the circumferential width. In this embodiment, the circumferential width essentially corresponds to the pitch 94, which is the distance between circumferentially adjacent keys 86 or grooves 88, which creates a geometry where the spacing between grooves 88 defines inversed keys 96 and the spacing between the keys 86 defines inversed grooves 98, with the inversed keys 96 having essentially same dimensions (width, radial depth) as the keys 86 and the inversed grooves 98 having essentially the same dimensions as the grooves 88, though oppositely oriented and adjusted to the annular geometry and required clearances. The circumferential spacing between adjacent keys and adjacent grooves can be constant and form a pitch 94. The grooves 88 and keys 86 can be said to have circumferentially and axially oriented bottoms and tips, respectively, and to extend between circumferentially opposite pressure faces 99 (aka pressure walls). The pressure faces 99 also extend axially and radially, but in some embodiments, such as the one illustrated, they can slope circumferentially inwardly from corresponding radial/axial oriented planes in the radially outward direction, at a pressure angle $\alpha$. The pressure angle $\alpha$ can be of 30°, 45°, or of another angle in alternate embodiments. The pressure faces 99 can be planar, or curved (e.g. involute). Depending of the embodiment, the pitch diameter and the pitch 94 can vary, which can affect the number of keys 86 and grooves 88 in a specific embodiment. The number of keys 86 and grooves 88 can be of at least 10, at least 30, or at least 50, for instance. In an embodiment having a radial space 68 of about 2 inches, the number of keys 86 and grooves 88 can be of about 70, for instance. The specific details of the spline design such as pressure angle $\alpha$, pitch 94, choice of straight or involute profile, pitch diameter (e.g. average diameter of the spline engagement 80), can be left to the designer in view of the specificities of corresponding embodiments.

Returning to FIG. 2, it will be noted that in the illustrated embodiment, the first and second discs 34, 38 each have a corresponding disc appendage 102, 104 protruding axially from the corresponding body 46, 48 in axially opposite directions. The first disc appendage 102 bears the male spline 82 as well as the two male spigot peripheries on corresponding portions of a radially outer surface thereof. The second disc appendage 104 bears the female spline 84 as well as the two female spigot peripheries on corresponding portions of a radially inner surface thereof.

In the illustrated embodiment, an air passage is defined for supplying cooling air to the gap 50. The air passage includes a hub cavity 74 formed radially internally in the first disc appendage 102, and an air passage portion 78 of the disc cavity 54. Moreover, the air passage includes a plurality of circumferentially interspaced first air passage segments 75 defined radially across the first disc appendage 102 and male spline 82, and a plurality of circumferentially interspaced second air passage segments 76 defined radially across the second disc appendage 104 and female spline 84. The first air passage segments 75 are clocked to fluidly communicate with the second air passage segments 76 as best seen in FIG. 3, to establish fluid flow communication across the spline engagement 80. Accordingly, during operation of the gas turbine engine 10, compressed air bled from the compressor section 14 can circulate within the hub cavity 74, across the spline engagement 80, into the air passage portion 78, and through the gap 50, into the working fluid, while being partitioned from the sub cavity 82 and gap 51.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications than the one presented above could be implemented by a person of ordinary skill in the art in view of the present disclosure, which modifications would be within the scope of the present technology.

The invention claimed is:

1. A gas turbine engine rotor assembly configured to rotate around an axis, the rotor assembly comprising:

a first disc having a first body extending circumferentially and radially around the axis, a first set of circumferentially distributed blades protruding radially from the first disc, and a male spline extending axially relative the first body, the male spline extending around and along the axis, and a second disc having a second body extending circumferentially and radially around the axis, a second set of circumferentially distributed blades protruding radially from the second disc, and a female spline extending around and along the axis, the female spline receiving the male spline in a spline engagement;

wherein the female spline includes a plurality of elongated, axially oriented grooves defined in a radially inner surface of the second disc, the grooves being circumferentially interspaced from one another, and the male spline includes a plurality of elongated, axially oriented keys protruding radially outwardly on a radially outer surface of the first disc, each one of the keys being snugly engaged within a corresponding one of the grooves to form the spline engagement;

wherein the first body and the second body have complementary cylindrical surfaces defining a spigot engagement therebetween.

2. The rotor assembly of claim 1 wherein the first disc has a disc appendage protruding radially from the first body, the first disc appendage having the male spline, the second disc has a second disc appendage protruding radially from the second body, the second disc appendage having the female spline.

3. The rotor assembly of claim 2, wherein the spigot engagement is a first spigot engagement between the first disc appendage and the second disc appendage, the rotor assembly further comprising a second spigot engagement between the first disc appendage and the second disc appendage, the spline engagement being between the first spigot engagement and the second spigot engagement relative to the axis.

4. The rotor assembly of claim 1, wherein the spigot engagement is axially adjacent to the spline engagement.

5. The rotor assembly of claim 1 wherein the first set of blades and the second set of blades extend across a main gas path, further comprising a disc cavity extending axially between the first disc body and the second disc body, radially internally from the main gas path, the disc cavity having less than 3 inches of radial depth.

6. The rotor assembly of claim 1 further comprising at least one cooling air passage extending radially across the spline engagement.

7. The rotor assembly of claim 1 wherein the keys and grooves have a corresponding circumferential width, and an axially oriented length, the length at least twice the width.

8. The rotor assembly of claim 1 further comprising inversed keys between adjacent ones of the grooves, and inversed grooves between adjacent ones of the keys the inversed keys engaged with the inversed grooves wherein the inversed keys have the same dimensions as the keys, and the inversed grooves have the same dimensions as the grooves.

9. The rotor assembly of claim 1 wherein the keys and grooves have pressure faces which slope relative to radial-axial planes in a manner for the keys and grooves to have narrower radially outer ends and broader radially inner ends.

10. The rotor assembly of claim 1 wherein the spline engagement include at least 30 of said keys.

11. The rotor assembly of claim 1 wherein the spline engagement include at least 50 of said keys.

12. The rotor assembly of claim 1 wherein the first disc and the second disc are turbine discs.

13. A gas turbine engine having in serial flow communication along a main gas path a compressor section, a combustor and a turbine section, at least one of said compressor section and said turbine section having a rotor assembly configured for rotation around an axis relative a stator, the rotor assembly comprising:

a first disc having a first body extending circumferentially and radially around the axis, a first set of circumferentially distributed blades protruding radially from the first disc across the main gas path, and a male spline protruding axially from the disc, the male spline extending around and along the axis, a second disc having a second body extending circumferentially and radially around the axis, a second set of circumferentially distributed blades protruding radially from the second disc across the main gas path, and a female spline extending around and along the axis, the female spline receiving the male spline in a spline engagement, and the stator having a set of circumferentially distributed vanes extending radially across the main gas path, axially between the first and second sets of blades;

wherein a disc cavity extends axially between the first disc body and the second disc body, radially internally from the main gas path to the spline engagement, further comprising a first annular gap and a second annular gap both fluidly connecting the disc cavity to the main gas path, the first annular gap between the first disc and the stator, the second annular gap between the stator and the second disc.

14. The gas turbine engine of claim 13 further comprising an air passage extending radially across the spline engagement.

15. The gas turbine engine of claim 14 wherein the stator further comprises a sealing assembly extending radially inwardly from the set of circumferentially distributed vanes into the disc cavity, the sealing assembly partitioning the disc cavity into an air passage portion fluidly connecting the air passage to the first annular gap, and a sub cavity fluidly connected to the second annular gap.

16. The gas turbine engine of claim 15 wherein the sealing assembly includes at least one baffle retained axially by an axial retention feature and centered by a centralizing feature associated to the axial retention feature.

* * * * *